US009953488B2

(12) United States Patent
Berman et al.

(10) Patent No.: US 9,953,488 B2
(45) **Date of Patent: *Apr. 24, 2018**

(54) SYSTEMS APPARATUSES AND METHODS FOR ENHANCING GAMING EXPERIENCES

(71) Applicant: KING SHOW GAMES, INC., Minnetonka, MN (US)

(72) Inventors: Bradley Berman, Minnetonka, MN (US); Chad Shapiro, Plymouth, MN (US); Adam Martin, St. Louis Park, MN (US); Dustin Rients, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,411

(22) Filed: Feb. 20, 2017

(65) Prior Publication Data

US 2017/0161994 A1 Jun. 8, 2017

Related U.S. Application Data

(63) Continuation of application No. 12/850,826, filed on Aug. 5, 2010, now Pat. No. 9,576,431.

(60) Provisional application No. 61/231,951, filed on Aug. 6, 2009.

(51) Int. Cl.
*G07F 17/32* (2006.01)

(52) U.S. Cl.
CPC ..... *G07F 17/3255* (2013.01); *G07F 17/3213* (2013.01); *G07F 17/3251* (2013.01); *G07F 17/3262* (2013.01); *G07F 17/3267* (2013.01)

(58) Field of Classification Search
CPC ..... G07F 17/3267; G07F 17/3293; G07F 17/3258
See application file for complete search history.

(56) References Cited

U.S. PATENT DOCUMENTS

| | | | | |
|---|---|---|---|---|
| 9,576,431 | B2 * | 2/2017 | Berman | G07F 17/3267 |
| 2004/0002376 | A1 * | 1/2004 | Swift | G07F 17/3267 463/25 |
| 2004/0152498 | A1 * | 8/2004 | Kaminkow | G07F 17/32 463/16 |
| 2006/0063584 | A1 * | 3/2006 | Brill | G07F 17/3244 463/20 |

* cited by examiner

*Primary Examiner* — Jasson Yoo

(57) ABSTRACT

Systems, apparatuses and methods for enhancing winning result opportunities in gaming activities. Embodiments involve identifying award-enhancing opportunities using dice, and enabling repetition of such award-enhancing opportunities based on the dice results until a terminating event occurs using the die/dice. Award-enhancing opportunities can be accumulated during the repetition, whereby payout opportunities of the gaming event from which the dice activity was initiated may be enhanced.

13 Claims, 11 Drawing Sheets

500 502

| | DICE ROLL | MULTIPLIER |
|---|---|---|
| 504 | 2 | 10x |
| | 3 | 6X |
| | 4 | 4X |
| | 5 | 3X |
| | 6 | 2X |
| 508 | 7 | 1ST ROLL: 7X<br>AFTER 1ST ROLL: END |
| | 8 | 2X |
| | 9 | 3X |
| | 10 | 4X |
| | 11 | 6X |
| 506 | 12 | 10x |

*FIG. 5*

| | 700 DICE ROLL | 702 FREE SPINS |
|---|---|---|
| 704 | 2 | +10 |
| 708 | 3 | +5 |
| | 4 | +3 |
| | 5 | +2 |
| | 6 | +1 |
| 712 | 7 | 1ST SPIN: +7<br>AFTER 1ST ROLL: END |
| | 8 | +1 |
| | 9 | +2 |
| | 10 | +3 |
| 710 | 11 | +5 |
| 706 | 12 | +10 |

*FIG. 7*

SYSTEMS APPARATUSES AND METHODS FOR ENHANCING GAMING EXPERIENCES

RELATED APPLICATIONS

This application is a continuation of U.S. application Ser. No. 12/850,826, filed Aug. 5, 2010, now U.S. Pat. No. 9,576,431, which claims the benefit of Provisional Patent Application No. 61/231,951, filed on Aug. 6, 2009, to which priority is claimed pursuant to 35 U.S.C. § 119(e), both of which are incorporated herein by reference in their entirety.

FIELD OF THE INVENTION

This invention relates in general to games, and more particularly to systems, apparatuses and methods for providing game features, such as slot game features.

BACKGROUND

It is desirable to provide captivating gaming opportunities for game players to maintain player interest, particularly where there are multiple chances of winning and/or increasing payout awards. In furtherance of the need to attract participants to particular gaming machines, there is a continuing need to further the excitement and anticipation in the participation of gaming activities. The present invention fulfills these and other needs, and offers advantages over prior art gaming approaches.

SUMMARY

To overcome limitations in the prior art described above, and to overcome other limitations that will become apparent upon reading and understanding the present specification, the present invention discloses systems, apparatuses and methods for providing game features.

In accordance with one embodiment, a method is provided that includes facilitating participation in a gaming event. A die/dice is presented, and an award-enhancing opportunity is identified in response to a number presented on the die/dice. The method involves enabling repetition of the presentation of the die/dice and the identification of the award-enhancing opportunity in response to the number presented until a triggering event occurs by way of the presentation of the die/dice, and enabling aggregation of the identified award-enhancing opportunities occurring during the repetition. Payout opportunities relative to the participation in the gaming event are enhanced using the aggregation of the identified award-enhancing opportunities.

In a more particular example of this method, identifying an award-enhancing opportunity involves identifying a multiplier value corresponding to the number presented on the die/dice, and enabling aggregation of the identified award-enhancing opportunities involves enabling the identified multiplier values to be summed together into an accumulated multiplier during the repetition. In yet a more particular embodiment, enhancing payout opportunities relative to the participation in the gaming event using the aggregation of the identified award-enhancing opportunities involves multiplying the accumulated multiplier value times a wager placed in the gaming event, where in another representative embodiment it involves multiplying the accumulated multiplier value times a payout provided during participation in the gaming event.

In another representative variation of such a method, identifying the award-enhancing opportunity involves identifying a number of free plays corresponding to the number presented on the die/dice, wherein the free plays are applied to the gaming event. In a further variation, enabling aggregation of the identified award-enhancing opportunities occurring during the repetition involves enabling, during the repetition, the identified number of free plays to be added to a current number of free plays available in the gaming event.

In still another variation of this representative method, enabling repetition of the presentation of the die/dice and the identification of the award-enhancing opportunity involves enabling repetition of the presentation of the die/dice and the identification of the award-enhancing opportunity in response to the number presented on the die/dice being any one of a first set of results, and discontinuing the repetition of the presentation of the at least one die and the identification of the award-enhancing opportunity in response to the number presented on the die/dice being any one of a second set of results. In a still more particular example, a pair of physical or virtual dice is used, where the first set of results includes the dice results of 2, 3, 4, 5, 6, 8, 9, 10, 11 and 12, and the second set of results includes the dice result of 7. In a further variation, repetition is still allowed if the first presentation of the dice is a 7, where repetition is thereafter discontinued on the next presentation of 7 on the dice.

In another particular variation of such a method, enabling repetition of the presentation of the die/dice and the identification of the award-enhancing opportunity involves enabling the repetition of the presentation of the die/dice and the identification of the award-enhancing opportunity in response to the number presented until at least one predetermined value is presented on the die/dice.

In another example, enhancing payout opportunities involves mathematically increasing actual payouts using the aggregation of the identified award-enhancing opportunities.

In one variation of such a method, the gaming event is a slot game involving payouts for matching symbols in a symbol display grid. One embodiment further involves triggering a gaming feature upon the occurrence of a defined triggering event(s) occurring during participation in the slot game, where the gaming feature includes the presentation of the die/dice, the identification of the award-enhancing opportunity, the enabling of the repetition of the presentation of the die/dice and the identification of the award-enhancing opportunity, the enabling of the aggregation of the identified award-enhancing opportunities, and the enhancement of the payout opportunities.

In accordance with another representative method, participation in a gaming event is facilitated. At least one die is presented, and a mathematical augmentation value is identified in response to a number presented on the die/dice. Some quantity of guaranteed repetitions of the presentation of the die/dice and the identification of the mathematical augmentation value is provided in response to the number presented. Following the guaranteed repetition, conditional repetition of the presentation of the die/dice and the identification of the mathematical augmentation value is enabled in response to the number presented, until a triggering event occurs by way of the presentation of the die/dice. Payout opportunities relative to the participation in the gaming event are enhanced using the identified mathematical augmentation values.

In one variation of such a method, identifying a mathematical augmentation value involves identifying one of a plurality of multiplier values depending on the number presented on the at least one die. In a more particular example, the identified multiplier values are multiplied by a wager placed in the gaming event. In an alternative representative embodiment, a play of the gaming event is provided during each guaranteed and conditional repetition, and the identified one of the multiplier values is multiplied by any payout provided during the play of each respective gaming event that is provided during each guaranteed and conditional repetition.

Another variation of such a method further involves providing a play of the gaming event at each guaranteed repetition and conditional repetition of the presentation of the die/dice and the identification of the mathematical augmentation value. In such an embodiment, enhancing payout opportunities relative to the participation in the gaming event using the identified mathematical augmentation values may involve applying the identified mathematical augmentation value to any payout occurring during the respective one of the plays of the gaming event.

In another particular variation, the representative method further involves providing a different set of mathematical augmentation values for at least a plurality of the guaranteed repetitions.

In accordance with another embodiment, an apparatus is provided that includes a processor configured to provide a primary gaming event and to initiate a secondary gaming event from the primary gaming event, a user interface configured to facilitate player participation in the gaming event, and a display to present a representation of dice. In one embodiment, the processor is configured to identify an award-enhancing opportunity in response to a value presented on the die/dice, enable repetition of the presentation of the dice and the identification of the award-enhancing opportunity dependent on the value presented until a terminating dice value is presented, enable aggregation of the identified award-enhancing opportunities occurring during the repetition, and enhance payout opportunities involving the primary gaming event using the aggregation of the identified award-enhancing opportunities.

In a more particular variation of such an apparatus, the processor is configured to identify the award-enhancing opportunity by identifying a multiplier value corresponding to the value presented on the dice, and to enable aggregation of the identified award-enhancing opportunities occurring during the repetition by enabling the identified multiplier values to be summed together into an accumulated multiplier during the repetition.

In another representative variation of such an apparatus, the processor is configured to identify the award-enhancing opportunity by identifying a number of free plays corresponding to the value presented on the dice, wherein the free plays are applied to the primary gaming event. In a still more particular example, the processor is configured to enable aggregation of the identified number of free plays by enabling, during the repetition, the identified number of free plays to be added to a current number of free plays available in the primary gaming event.

In accordance with another embodiment, an apparatus is provided that includes a processor configured to provide a primary gaming event and to initiate a secondary gaming event from the primary gaming event, a user interface configured to facilitate player participation in the gaming event, and a display to present a representation of dice. In one embodiment, the processor is configured to identify a multiplier dependent on a value presented on the dice, and provide a quantity of guaranteed repetitions of the presentation of the dice and the identification of the multiplier. Following the guaranteed repetition, one embodiment involves the processor further enabling conditional repetition of the presentation of the dice and the identification of the multiplier until a terminating dice value is presented, and enhancing payout opportunities involving the primary gaming event using the identified multiplier values.

Other embodiments involve a computer-readable medium (s) that has instructions stored thereon that are executable by a computing system by performing functions associated with any of the method embodiments described herein.

These and various other advantages and features of novelty are pointed out with particularity in the claims annexed hereto and form a part hereof. However, for a better understanding of the operation and advantages, reference should be made to the drawings which form a further part hereof, and to accompanying descriptive matter, in which there are illustrated and described representative examples of systems, apparatuses, and methods associated with the invention.

BRIEF DESCRIPTION OF THE DRAWINGS

The description herein refers to embodiments illustrated in the following diagrams.

FIG. 5 illustrates a representative correlation between dice roll results and their impact on payouts of the gaming event using mathematical augmentation;

FIG. 7 illustrates a representative correlation between dice roll results and their impact on payouts of the gaming event through increased opportunities in a primary gaming event;

DETAILED DESCRIPTION

Figure 1:
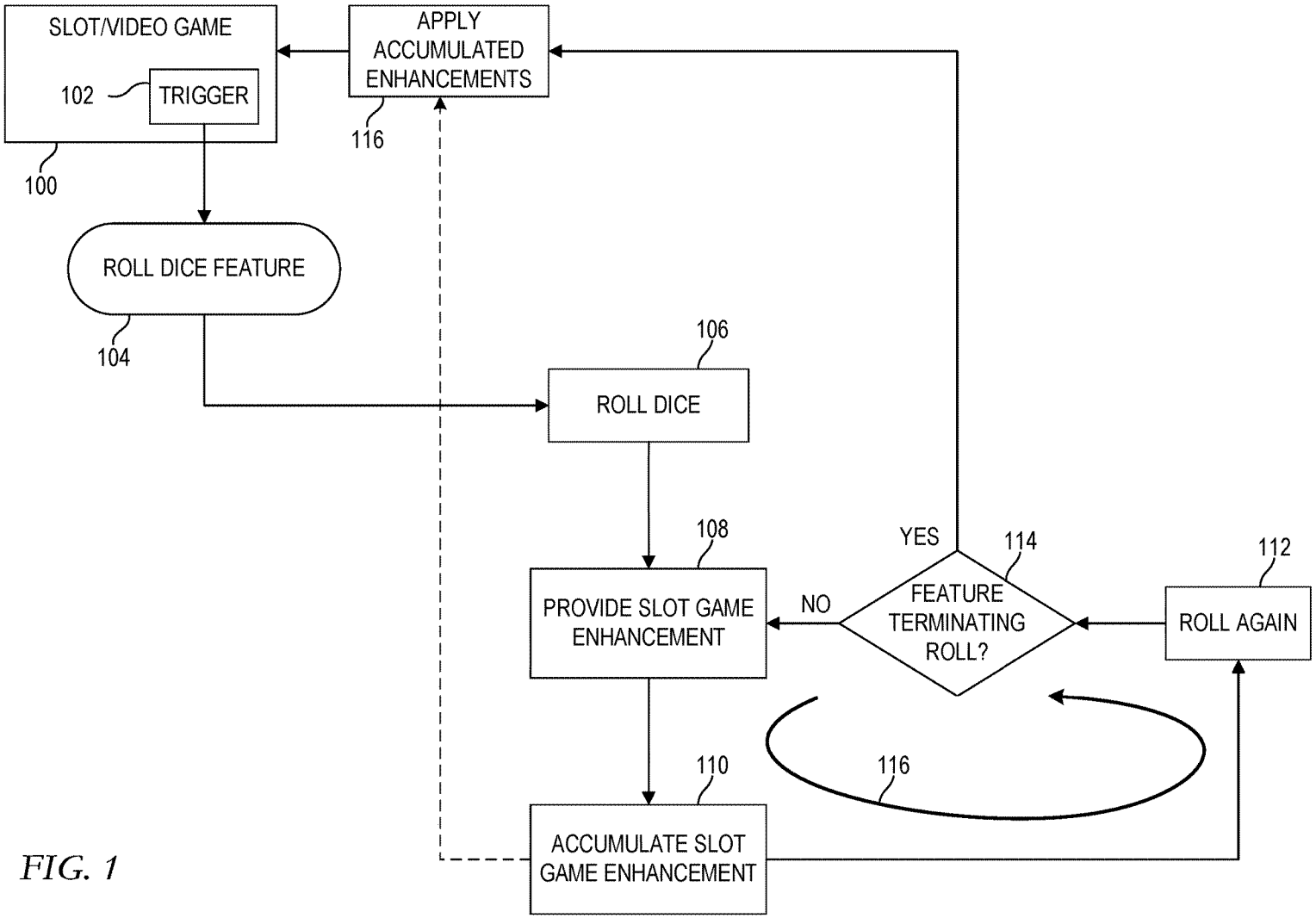
FIG. 1 illustrates a representative manner for enhancing award opportunities in connection with a gaming event.

In the following description of various exemplary embodiments, reference is made to the accompanying drawings which form a part hereof, and in which is shown by way of illustration representative embodiments in which the invention may be practiced. It is to be understood that other embodiments may be utilized, as structural and operational changes may be made without departing from the scope of the invention.

Generally, systems, apparatuses and methods are provided for enhancing winning result opportunities in gaming activities. Embodiments involve identifying award-enhancing opportunities using an actual or virtual die/dice, and enabling repetition of such award-enhancing opportunities based on the die/dice results until a terminating event occurs using the die/dice.

For example, one representative method is used in connection with a gaming event, such as a slot game where payouts are provided for certain matching symbols in a symbol display grid. A die/dice is presented, and award-enhancing opportunities are identified in response to the die/dice "roll" or other presentation. In such an embodiment, the die/dice presentation and corresponding award-enhancing opportunities are allowed to repeat, thereby aggregating award-enhancing opportunities, until the die/dice provide a result that triggers the end of the award-enhancing opportunities. In this manner, payout opportunities are enhanced in the original gaming event.

Other embodiments involve an apparatus configured to enhance awards/payouts in such a manner. For example, a display may be configured to present the die/dice, and a processor may be configured to identify award-enhancing opportunities in response to the die/dice presentation. In such an example, the processor is configured to allow the die/dice presentation and corresponding award-enhancing opportunities to repeat, and aggregate the award-enhancing opportunities, until the die/dice provide a result that triggers the end of the award-enhancing opportunities. The processor may also be configured to calculate payouts that are statistically, or at least perceived to be, more likely to occur.

Another representative method presents a die/dice, and identifies an mathematical augmentation value in response to a number presented on the die/dice. Some number of repetitions of the die/dice presentations (e.g., "rolls") and resulting mathematical augmentation value identifications are guaranteed. An example is to guarantee four free spins in the primary game, where each free spin is also associated with one of the dice rolls and mathematical augmentation value identifications. In this embodiment, following the guaranteed number of repetitions of dice rolls and mathematical augmentation value identifications, conditional repetition of the presentation of the die/dice and mathematical augmentation value identification is provided until a triggering event occurs by way of the presentation of the die/dice. Payout opportunities relative to the participation in the gaming event may be enhanced using the identified mathematical augmentation values.

The systems, apparatuses and methods described herein may be implemented as a single game, or part of a multi-part game. For example, the games described herein may be implemented in a primary slot game, and/or in a bonus game(s) or other secondary games associated with a primary slot game. Thus, while various embodiments described herein may be described in terms of a bonus event of a gaming activity, it is equally applicable to main/primary gaming and other non-bonus events. The invention may be used as a stand-alone game, a primary/base game of a slot game, a bonus game of a slot game, etc.

A representative embodiment for enhancing award opportunities in connection with a gaming event is shown in FIG. 1. In this embodiment, the gaming event or activity is a slot or video game 100. For example, the game 100 may represent a slot game where mechanical or virtual/electronic reels or other symbols in display segments are "spun" or otherwise rearranged to provide a random presentation of the symbols. When certain symbols are presented in a matching fashion, or otherwise conform to symbol arrangement rules, the result is a winning symbol combination(s) in which payouts may be made when implemented in a wagering environment.

The embodiment of FIG. 1 includes a secondary feature, which is depicted as a dice feature 104 in FIG. 1. The dice feature 104 may be provided in connection with a primary or native game of the slot/video game 100, or in connection with a secondary or bonus event. The feature 104 may be allowed to occur at all times during play of the game 100, in connection with predetermined events, at random times, in response to triggering events, and/or in connection with other times or events established by the rules of the game. In the illustrated embodiment, the feature 104 is initiated upon the occurrence of a triggering event 102 occurring in the slot/video game 100. As merely an example of such a triggering event, assume the game 100 represents a slot game, in which case the presentation of a predetermined number of a particular symbol may trigger the roll dice feature 104. As a more particular example, the trigger 102 may involve obtaining three established bonus symbols anywhere on the presented "reels" or other display segments of the primary gaming event 100.

The roll dice feature 104 of the embodiment of FIG. 1 includes rolling at least one die, as shown at block 106. "Rolling" the die/dice in this regard may involve physically rolling a die/dice, providing a visual representation (e.g., graphical or other electronic display) of rolling a die/dice, providing a visual representation of the face(s) of the die/dice, etc. References to "rolling" the die/dice is meant to broadly represent changing or otherwise presenting the result of the face(s) of the die/dice, and is not intended to require actual or visual movement or rolling of the die/dice, although some embodiments involve such actual/visual movement. It should also be noted that while the player may initiate or otherwise have total or partial control of "rolling" the actual or virtual dice, this may be an automatic feature or otherwise out of the player's control in other embodiments.

As a result of rolling the die/dice 106, one embodiment involves providing a slot game enhancement 108. In this embodiment, the player is guaranteed at least one slot game enhancement 108, although other embodiments may disallow any slot game enhancement if the result of the die/dice roll is a terminating roll (which are discussed in greater detail below). However, in the illustrated embodiment, the first roll of the die/dice results in the player obtaining at least one slot game enhancement 108. The slot game enhancement, also referred to herein as an award-enhancing opportunity, represents some potential or actual benefit to the player, whether or not it ultimately increases the player's payout. For example, one example of a slot game enhancement is a mathematical function that can increase the player's payout in the slot game 100, or at least a chance to increase the player's payout in the slot game 100. In another example, the slot game enhancement is one or more free plays or free "spins" in the primary slot game 100. These and other award-enhancing opportunities are contemplated for use in connection with the description provided herein. In some embodiments, there is still a perceived benefit to the player, such as by providing multipliers or free spins, even though the ultimate outcome does not actually increase the payout to the player.

The embodiment of FIG. 1 involves accumulating the acquired slot game enhancements as shown at block 110. In one embodiment this involves enabling repetition of the rolling of the dice and identification of slot game enhancements, and accumulating any provided slot game enhancements. This repetition is depicted in FIG. 1 by enabling a further roll 112 of the dice, and determining if the roll 112 of the dice represents a terminating roll as determined at decision block 114. If not, a slot game enhancement 108 is again provided based on the result of the die/dice roll. This can continue to repeat, as depicted by arrow 116, until it is determined 114 that a terminating roll occurred. The terminating roll may be, for example, a particular number(s) presented on the die/dice. In one embodiment, a processor may be utilized to compare the presented dice roll result 108/112 to established die/dice setpoints to determine whether the presented die/dice roll will provide a slot game enhancement 108 or result in a terminating roll 114. Comparators and/or other comparison circuitry may also be used to make such a determination.

As an even more specific, representative example, a terminating roll may be a roll of "7" (e.g., the pips on the dice total "7") on a pair of dice. In this example, other dice rolls may provide the slot game enhancements 108. For example, obtaining a roll of "2" may provide a first slot game enhancement, while a roll of "3" may provide the same or a different slot game enhancement. In one embodiment, each of the possible rolls of the dice is defined to provide either some slot game enhancement or an end to providing the slot game enhancements. In other embodiments, one or more rolls of the die/dice may provide no enhancement or identify an end to providing such enhancements.

Where no terminating roll 114 has occurred, the die/dice roll repeats such that the provided slot game enhancements 108 can be accumulated 110. For example, where the slot game enhancement represents a multiplier (e.g., particular multiplier values corresponding to particular die/dice results), the multiplier values may be accumulated by adding, multiplying, or otherwise mathematically manipulating the provided multipliers. In such an embodiment, the accumulation 110 may be implemented by storing the provided 108 multipliers, and adding the multipliers together to arrive at an accumulated multiplier (or simply adding newly acquired multipliers to a running total), which may again be stored in a memory or other storage component. For example, with four die/dice rolls before obtaining a terminating roll 114, the provided multipliers may be 2×, 3×, 3× and 5×, resulting in an accumulated slot game enhancement of 13× (e.g., 2×+3×+3×+5×=13×). In one embodiment, when a terminating roll 114 occurs, the accumulated multiplier is then applied 116 to the slot/video game 100. For example, in one embodiment, the accumulated multiplier is applied to the player's total wager, such that if the player had wagered ten credits, the total award would be one-hundred-thirty credits where the accumulated slot game enhancement was a 13× multiplier.

In another example, the slot game enhancement may represent a free play/spin award. Such an award enables the player to "spin the reels" or otherwise engage in another gaming event of the game 100. In such an embodiment, where no terminating roll 114 has occurred, the die/dice roll repeats such that the provided free slot game enhancements 108 (i.e., free spins/plays in this example) can be accumulated 110 by adding, multiplying, or otherwise mathematically manipulating the provided number of free spins/plays. In one embodiment, the accumulation 110 of such free plays may be implemented by adding the provided 108 free plays to a running total of free plays. For example, a free play meter may be provided via a user interface by which the player can be aware of the current number of free plays available, where the accumulation 110 of such free plays increases as the player is provided 108 with more free plays and decreases as the player expends the free plays. In one embodiment, this accumulated number of slot game enhancements 110 is immediately applied 116 to the slot/video game 100 to enable the player to expend the free spins. In one embodiment, when the terminating roll 114 has occurred, no further free spins will be awarded 108, but the player may expend the accumulated total 110 until no free spins remain.

Figure 2:
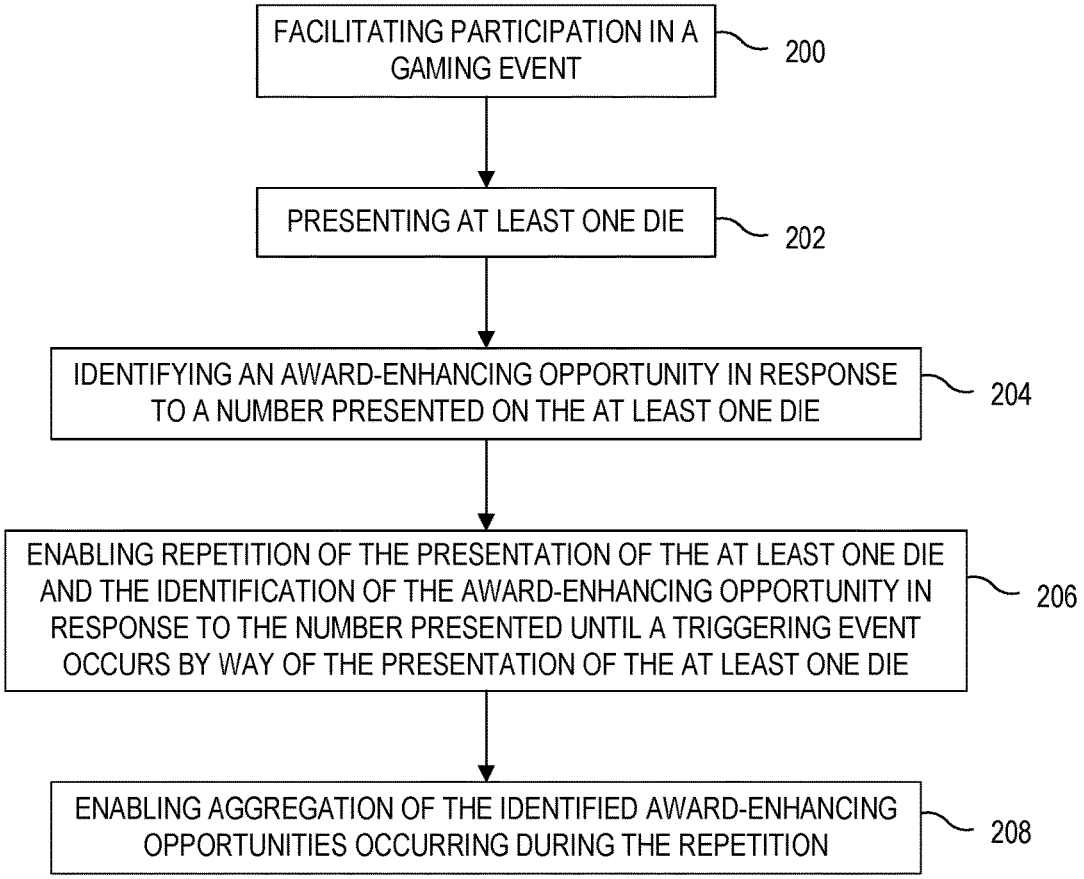
FIG. 2 is a flow diagram illustrating a representative method for providing award-enhancing opportunities using a die/dice.

FIG. 2 is a flow diagram illustrating a representative embodiment. Participation in a gaming event is facilitated 200. For example, a user interface including one or both of a user input interface and an output interface (e.g., display, audio, etc.) may be provided to enable the player access to the underlying gaming event. At least one die is presented 202, and an award-enhancing opportunity is identified 204 in response to a number presented on the die/dice. As shown at block 204, the representative method involves facilitating repetition of the presentation of the die/dice and the identification of the award-enhancing opportunity in response to the number presented on the die/dice, until a triggering event occurs by way of the presentation of the die/dice. Aggregation of the identified award-enhancing opportunities occurring during the repetition is facilitated 206. In one embodiment, payout opportunities relative to the participation in the gaming event are enhanced using the aggregation of the identified award-enhancing opportunities.

In one embodiment, the facilitated gaming event 200 is a slot game. In one embodiment the various functions 202-208 are triggered as a gaming feature upon occurrence of some triggering event(s) occurring during participation in the slot game, although the functions 202-208 may be provided at any time and/or based on any rules. The gaming event 200 is an entirely different gaming event than the functions 202-208 in some embodiments, such as where the gaming event is symbol-based slot game and the functions 202-208 involve the dice roll feature. The presentation 202 of the die/dice may be, for example, a visual and/or audio presentation of the number of pips presented on a single die or the total number of pips presented on multiple dice. Other "dice" may simply include a number or other numeric indicator on each face that form another number or total another number. The die/dice may be visually presented in any desired manner, such as by way of an electronic display, by way of mechanical moving die/dice, actual die/dice, etc.

Identifying the award-enhancing opportunity 204 may involve, for example, identifying a multiplier value corresponding to the number presented on the die/dice. In such an embodiment, enabling or otherwise facilitating aggregation of the identified award-enhancing opportunities 208 may involve enabling the identified multiplier values to be added into an accumulated multiplier during the repetition. In one related embodiment, the accumulated multiplier value may be multiplied times a wager placed in the gaming event. In an alternative representative embodiment, the accumulated multiplier value may be multiplied by a payout or other award provided during participation in the gaming event.

Other representative embodiments involve free plays. In one example of such an embodiment, identifying the award-enhancing opportunity 204 involves determining the number of free plays based on what number is presented on the die/dice. Such free plays may be applied to the gaming event; e.g., the player may obtain free spins in the gaming event that triggered the dice feature. In such an embodiment, enabling aggregation of the identified award-enhancing opportunities 208 may involve enabling, during the repetition, the identified number of free plays to be added to a current number of free plays available in the gaming event. Multipliers and free plays merely represent examples of award-enhancing opportunities capable of use in connection with the principles described herein.

In one representative embodiment, enabling repetition 206 involves enabling repetition of the presentation of the die/dice and the identification of the award-enhancing opportunity in response to the number presented on the die/dice being any one of a first set of results (e.g., any of a 2, 3, 4, 5, 6, 8, 9, 10, 11 and 12), and disallowing further repetition in response to the number presented on the die/dice being any one of a second set of results (e.g., a 7). These are merely examples of how repetition may be determined based on the state of the presented die/dice.

In other embodiments, some number of repetitions 206 may be guaranteed, and one or more further repetitions may be conditional on the state of the rolled die/dice. Examples of such embodiments are described in further detail below.

Figure 3:
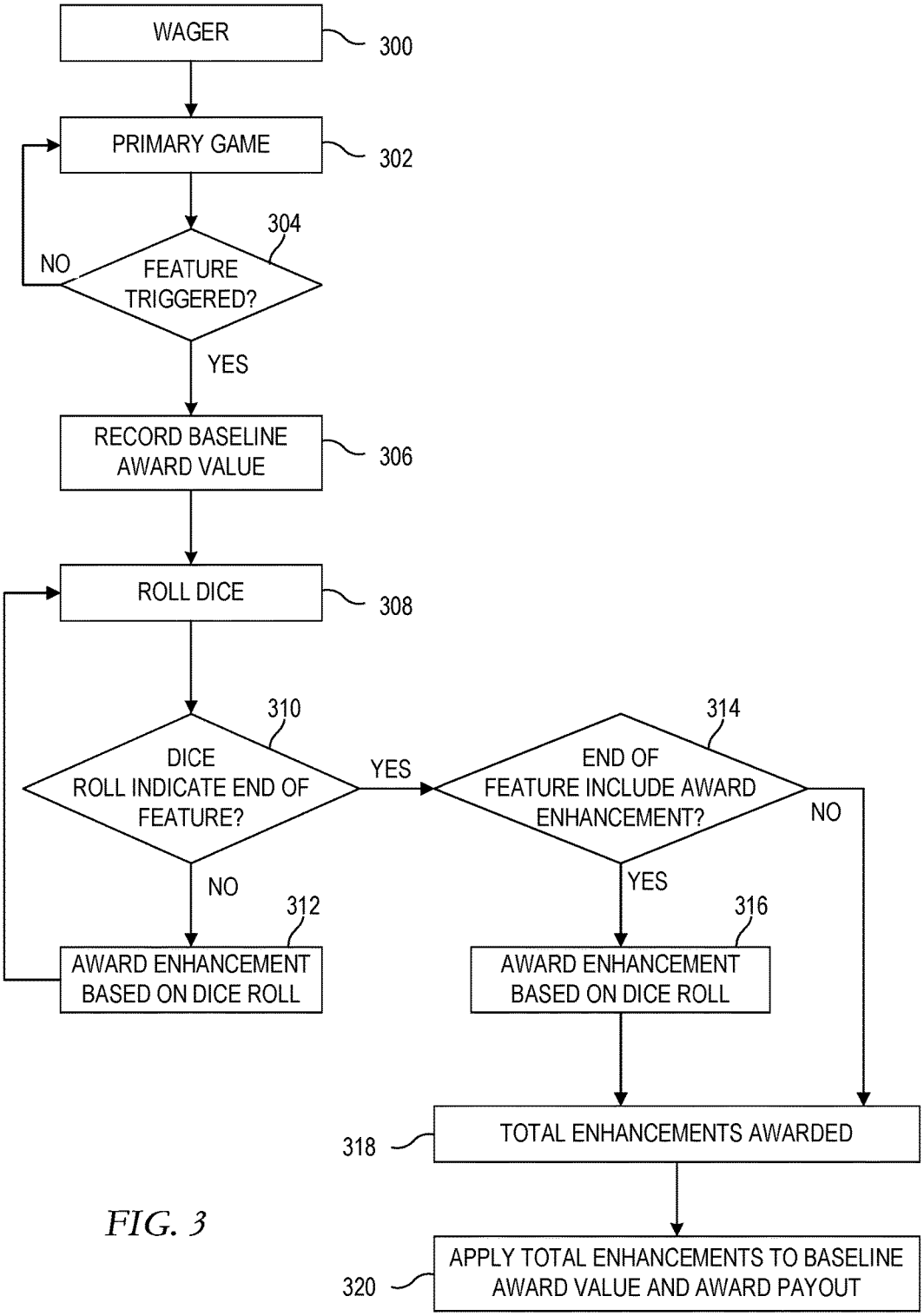
FIG. 3 is a flow diagram of a representative embodiment in which award opportunities in a primary game are enhanced using a die/dice.

FIG. 3 is a flow diagram of another representative embodiment in which award opportunities are enhanced. This embodiment assumes a wager-based game, such as a slot game requiring player wagers 300 in which to participate. This embodiment also assumes that a native or primary game 302 is operable on the slot machine, where the dice feature may be triggered by something occurring during participation in the primary game. If the feature is not triggered 304, facilitation of participation in the primary game continues. If, however, the feature is triggered 304, participation in the dice roll feature is enabled. For example, obtaining the requisite symbols in the primary game based on rules may trigger the feature. In the illustrated embodiment, when the feature is triggered 304, a baseline award value may be recorded 306. This baseline award may be, for example, a number of free spins already available to the player, the total wager placed by the player for that particular slot event (e.g., for that "spin" of the reels), the payout obtained for that particular slot event, or any other baseline award to which the award-enhancing opportunity is to be applied. A die/dice result is presented 308, which is generally referred to herein as "rolling the dice." If, as determined at decision block 310, the dice roll does not indicate that the feature is to end, then an award enhancement is provided 312 based on that dice roll. However, as previously noted, some embodiments disregard a dice roll indicating the end of feature, and optionally provide 312 an award enhancement, up to the Nth occurrence of that terminating dice roll. For example, where N=1, the feature is not terminated on the first occurrence of the terminating dice roll, but will be terminated on the second occurrence of that terminating dice roll.

Where block 312 is reached, the dice may then be rolled 308 again, and the process 308, 310, 312 may continue until the dice roll indicates 310 the end of the feature. In such case, one embodiment may still provide an award for that dice roll, even though the dice roll indicated that the feature is to end. This is depicted by determining 314 if the end of feature roll includes an award enhancement. If so, the enhancement is awarded 316 based on the dice roll; else no further enhancement is provided. In either case, the total enhancements awarded 318 is determined, which represents an accumulation of the awards 312, and possibly 316, that were provided during participation in the feature. In one embodiment the total enhancements 318 are applied 320 to the previously recorded baseline 306, and a payout may be provided.

Figure 4:
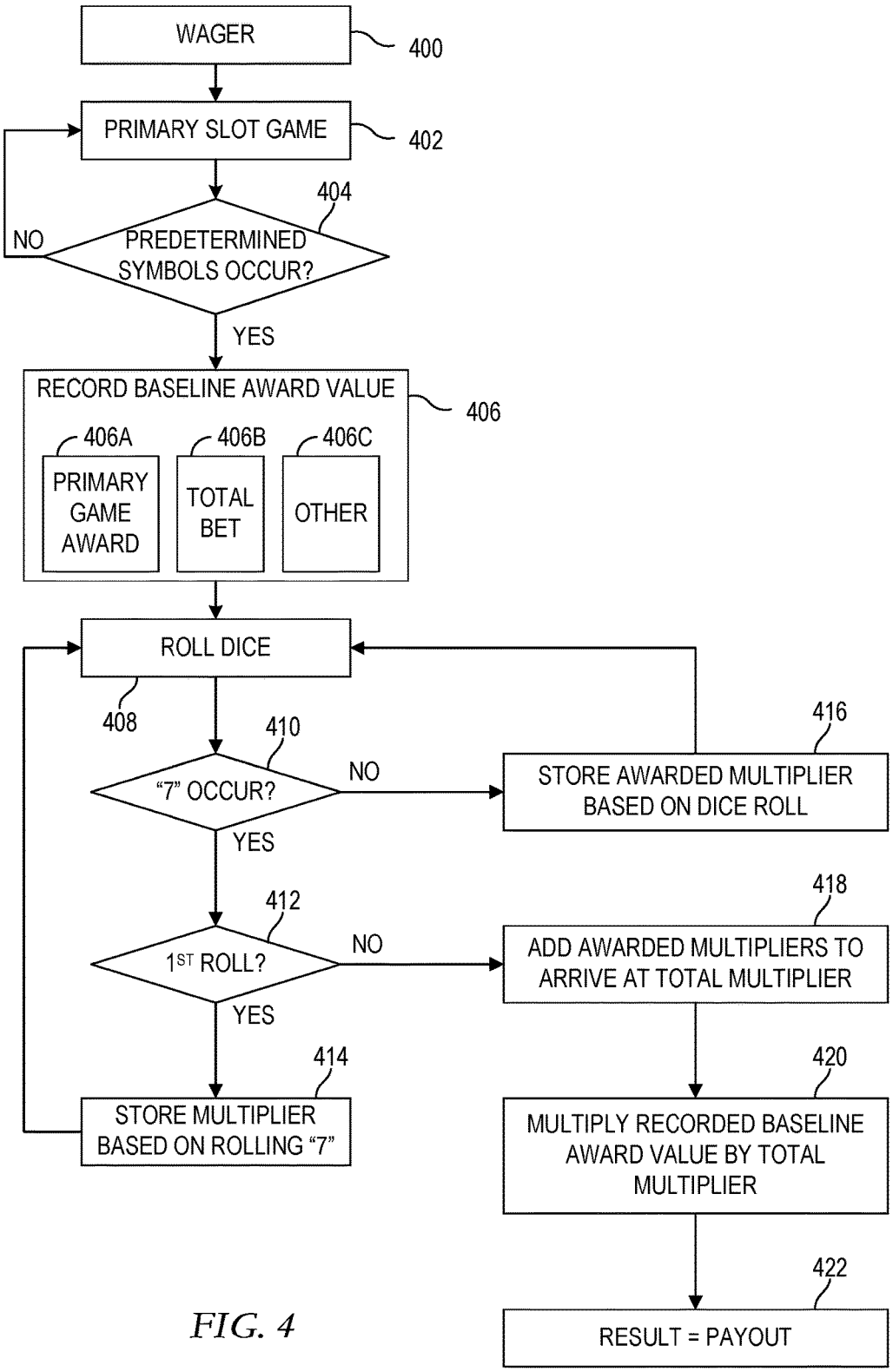
FIG. 4 is a flow diagram of a representative embodiment in which award opportunities in a primary game are enhanced with multipliers.

FIG. 4 is a flow diagram of another representative embodiment in which award opportunities are enhanced. This embodiment again assumes a wager-based game, such as a slot game requiring player wagers 400 in which to participate. This embodiment also assumes that a native or primary game 402 is operable on the slot machine, where the dice feature is triggered upon the occurrence of predetermined symbol(s) or a predetermined symbol combination occurring as determined at block 404. If the predetermined symbol(s) or combination does not occur, participation in the primary game continues. If the predetermined symbol(s) or combination occurs, participation in the dice roll feature is enabled. In the illustrated embodiment, a baseline award value is recorded 406, which may represent a primary game award 406A, total bet 406B or other 406C baseline value. Other 406C exemplary baseline values may be a fixed or random baseline value or based on other rules.

The dice faces are presented 408, such as by a visualization of the dice being rolled. In the embodiment of FIG. 4, a set of rules are applied to identify multiplier values and termination events based on the state of the rolled dice. FIG. 5 is a table showing a representative embodiment involving termination values and multiplier values as the award-enhancing opportunities. It should be recognized that "tables" described herein, such as the table of FIG. 5, are shown for purposes of example and are not intended to suggest a particular data structure unless otherwise noted (although table data structures may be utilized). Referring to FIG. 5, particular dice rolls 500 (assuming two dice in this embodiment) are correlated to multiplier values and termination conditions 502. Particularly, correlating row 504 indicates that a roll of "2" (e.g., one pip on each of two standard dice or virtual dice) provides a multiplier value of "10." A multiplier of 10× is also provided for a roll of "12" as noted at row 506. As can be seen in the example of FIG. 5, different dice rolls may produce different multiplier values. Further, in the example of FIG. 5 a dice roll of "7" has additional rules that are further described in connection with FIG. 4.

Referring now to FIGS. 4 and 5, it is determined 410 whether a "7" has been rolled. If so, it is determined 412 whether it is the first time that a "7" has been rolled during participation of this instance of the feature. If so, it does not represent a feature-terminating event, although it would otherwise. As shown at row 508 of FIG. 5, if the first roll results in a "7," a 7× multiplier is awarded in this embodiment. After the first roll, rolling a "7" ends the award-enhancing feature, and no further awards are accumulated. This is depicted in FIG. 4, where a multiplier is stored 414 based on rolling a "7" if the roll was determined 412 to be the first roll. In this case, the player is allowed to continue to roll the dice 408, and the process continues.

If a "7" is not rolled as determined at decision block 410, then one of the multipliers shown in FIG. 5 is awarded, which may be stored 416, and the player is again allowed to roll the dice 408. In this particular example, if any of a 2, 3, 4, 5, 6, 8, 9, 10, 11 or 12 is rolled, some corresponding multiplier value is awarded. This continues until the player rolls a "7" on any roll beyond the first roll, as determined at decision blocks 410 and 412. In the illustrated embodiment, no further multiplier is awarded when a "7" is rolled beyond the first roll, but an award may be provided with the terminating roll. In the illustrated embodiment, the multipliers obtained at blocks 414 and/or 416 are added together 418 to arrive at a total multiplier award. This provides an award-enhancing opportunity, such as where the baseline award value is a non-zero value that can be increased through multiplication. The recorded baseline award value is multiplied 420 by the total multiplier, which results in an enhanced payout 422.

It should be noted that the storing of multipliers at 414, 416 and ultimate adding 418 of the multipliers is depicted in this fashion for purposes of illustration. However, any manner of accumulating the multipliers may be implemented. For example, rather than storing the specific multipliers at blocks 414, 416 and adding 418, the accumulation can be implemented by storing a running count of the current accumulated value. For example, a multiplier of "3×" may be stored as a running count, and another multiplier of "4×" may be awarded such that the running count is increased to "7×." Thus, the particular representation in FIG. 4 for identifying the accumulated award-enhancing opportunity should not be seen as limiting, but rather merely as an example of an accumulation technique.

Figure 6:
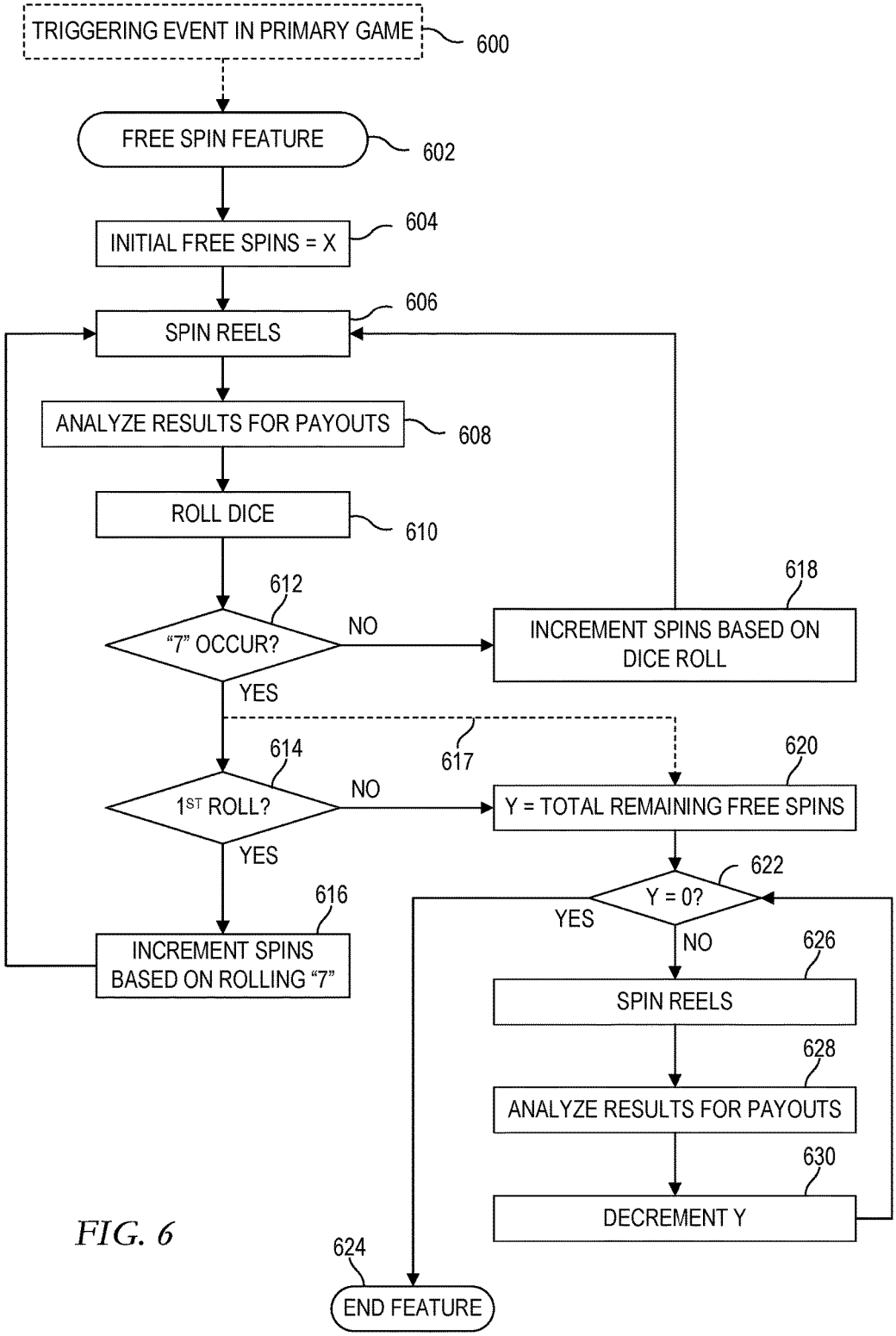
FIG. 6 is a flow diagram of a representative embodiment in which award opportunities in a primary game are enhanced with additional plays of the gaming event.

FIG. 6 is a flow diagram of another representative embodiment in which award opportunities are enhanced. As will be described in more detail below, this embodiment involves an award-enhancing opportunity in the form of additional opportunities to win payouts in a primary game, and more particularly in the form of free plays (or "free spins" in the context of symbol-based mechanical or virtual reel slot games). As in other embodiments, this embodiment may or may not involve a player wager.

In the embodiment of FIG. 6, a free spin feature 602 is provided, which may optionally be triggered 600 from the primary game. When entering the free spin feature 602, the player may or may not already have accumulated some free spins. This is depicted by block 604, where the number of initial free spins is currently at "x," where x in one embodiment can represent any number between zero and some positive integer. For example, in the event that the free spin feature 602 is the only manner in which a player can obtain free spins, then the number of initial free spins may be zero. On the other hand, the player may have currently or previously won free spins that can be utilized in the free spin feature 602.

Block 606 indicates "spin reels," which in one embodiment represents randomly presenting symbols in the primary slot game. The results are analyzed 608 for payouts, either presently or recorded for payout at a later time. One or more dice are then rolled 610 as previously described. For purposes of example, the embodiment of FIG. 6 assumes that two dice are presented, and a set of rules are applied to identify free spin values and termination events based on the state of the rolled dice. FIG. 7 is a table showing a representative embodiment involving termination values and free spin quantities as the award-enhancing opportunities. In FIG. 7 particular dice rolls 700 are correlated to free spin quantities and termination conditions 702. Particularly, correlating rows 704 and 706 indicate that dice presentations of "2" and "12" each provide ten free spins, rows 708 and 710 indicate that dice presentations of "3" and "11" each provide five free spins, and so forth. Further, in the example of FIG. 7 a dice roll of "7" has additional rules that are further described in connection with FIG. 6.

Referring now to FIGS. 6 and 7, it is determined 612 whether a "7" has been rolled. If so, it is determined 614 whether it is the first time that a "7" has been rolled during participation of this instance of the feature. If so, it does not represent a feature-terminating event, although it would otherwise. As shown at row 712 of FIG. 7, if the first roll results in a "7," seven free spins are awarded in this embodiment. After the first roll, rolling a "7" ends the award-enhancing feature, and no further awards are accumulated in this embodiment. This is depicted in FIG. 6, where the number of free spins available to the player is incremented 616 based on rolling a "7" if the roll was determined 614 to be the first roll. In this case, the player is allowed to continue to spin the reels 606 and roll the dice 610, and the process continues. It should be noted that some embodiments do not allow for rolling the terminating number some number of times before it becomes a terminating event, such as depicted by line 617 which terminates the potentially repeating dice rolling process.

If a "7" is not rolled as determined at decision block 612, then one of the free spin quantities shown in FIG. 7 is awarded, which results in incrementing 618 the number of spins available to the player. In this case, the player is allowed to continue to spin the reels 606 and roll the dice 610. In this particular example, if any of a 2, 3, 4, 5, 6, 8, 9, 10, 11 or 12 is rolled, some corresponding number of free spins is awarded. In this embodiment, this continues until the player rolls a "7" on any roll beyond the first roll, as determined at decision blocks 612 and 614. In the illustrated embodiment, no further free spins are awarded when a "7" is rolled beyond the first roll, and an award may or may not be provided with the terminating roll. In any event, there may be a number (e.g., "Y") of total remaining free spins 620 at the time the terminating dice roll occurs. If no free spins are remaining as determined at decision block 622 (i.e., Y=0 in this example), then the feature ends 624. Otherwise, the reels are spun 626 again, and the results are analyzed 628 for payouts. This continues until there are no remaining free spins. A depiction of continuing the free spins 626 and analyzing the results 628 until there are no further free spins is provided by decrementing 630 the count value "Y" until Y=0 as determined at block 622. It should be noted that the description of such a variable "Y" and decrementing such count is provided for purposes of illustration, and is not intended to suggest the only way to determine when the free spin count has reached zero.

Figure 8:
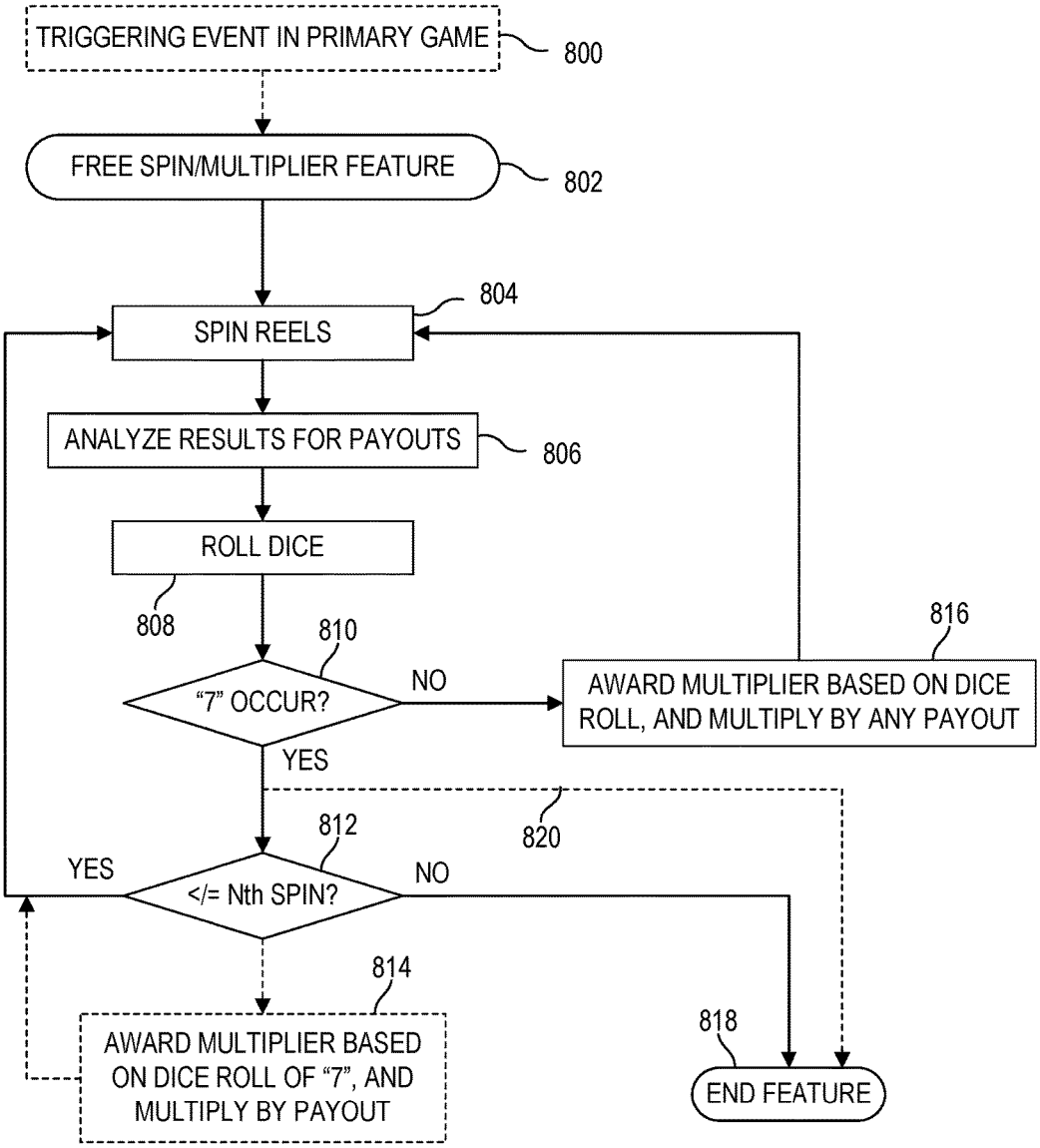
FIG. 8 is a flow diagram of a representative embodiment in which award opportunities in a primary game are enhanced with mathematical augmentation and additional plays of the gaming event.

FIG. 8 is a flow diagram of another representative embodiment in which award opportunities are enhanced. As will be described in more detail below, this embodiment involves an award-enhancing opportunity in the form of additional opportunities to win payouts in a primary game, such as free plays, as well as additional opportunities to increase the amount of payouts.

In the embodiment of FIG. 8, a free spin and multiplier feature 802 is provided, which may optionally be triggered 800 from the primary game. When entering the feature 802, the player may or may not already have accumulated some free spins as described in connection with FIG. 6. Block 804 indicates "spin reels," which in one embodiment represents randomly presenting symbols in the primary slot game. The results are analyzed 806 for payouts, either presently or recorded for payout at a later time. One or more dice are then rolled 808 as previously described. For purposes of example, the embodiment of FIG. 8 assumes that two dice are presented, and a set of rules are applied to identify termination events and multiplier values for some number of free spins based on the state of the rolled dice.

Figure 9:
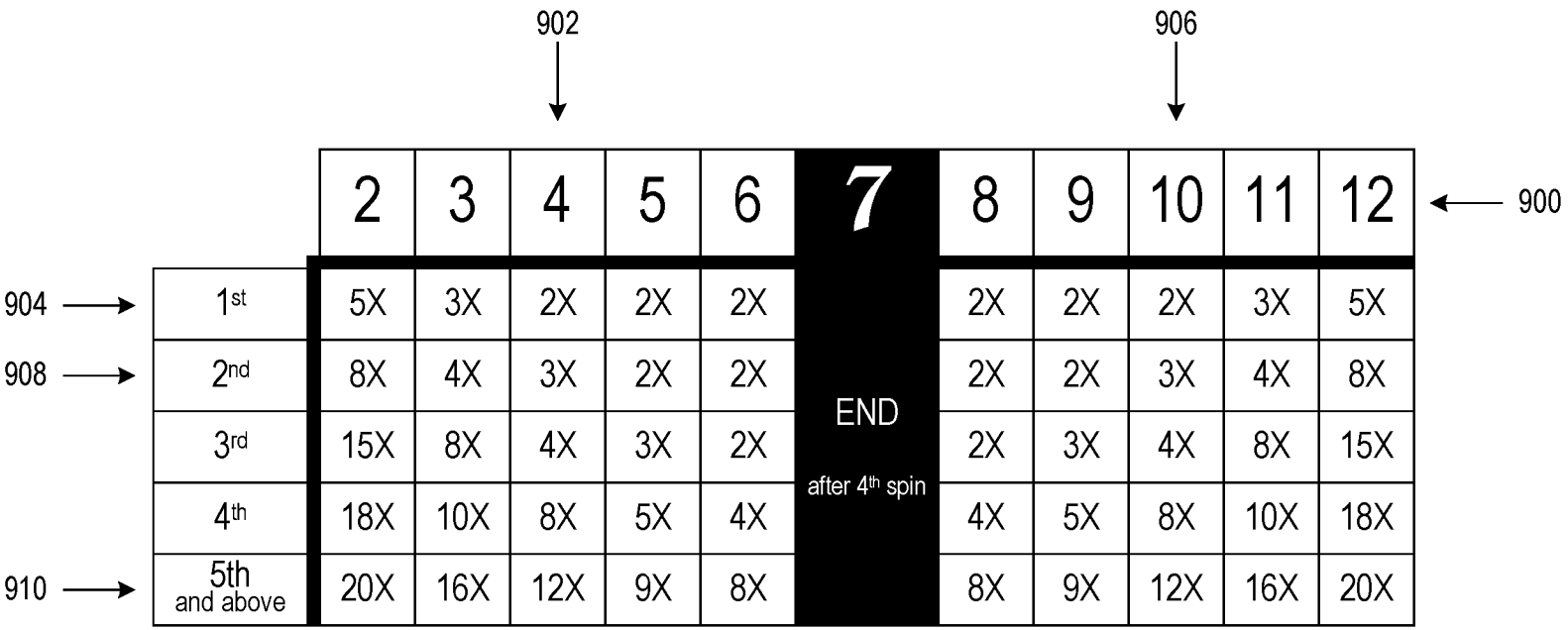
FIG. 9 illustrates a representative correlation between dice roll results and their impact on payouts of the gaming event through mathematical augmentation and increased opportunities in a primary gaming event.

Referring now to FIG. 9, a table illustrates a representative embodiment involving termination values and multipliers for a number of free spins as the award-enhancing opportunities. In FIG. 9 particular dice rolls 900 are correlated to multiplier values that depend on which roll of the dice has occurred. In one embodiment, it is assumed that some number of free spins and respective dice rolls are guaranteed. For example, in the embodiment of FIG. 9, it is assumed that four free spins are guaranteed to the player, and occurrence of a particular value(s) on the dice will end the feature on the fifth roll or higher. In the example of FIG. 9, if a "4" 902 is rolled on the first roll 904, the player is awarded with a 2× multiplier. In one embodiment this multiplier is used to increase a payout obtained by the player on that particular spin of the reels, although other embodiments may allow for multiplier accumulation as previously described. If a "10" 906 is rolled on the second roll 908, the player is awarded with a 3× multiplier that may be used to increase any payout obtained by the player on that particular spin. According to the rule set of FIG. 9, if a "7" is rolled in the first "N" rolls (where N=4 in the embodiments of FIGS. 8 and 9), the feature does not end, and a multiplier may or may not be awarded for rolling this established dice value(s). However, on the $5^{th}$ spin 910 and corresponding dice roll, or any spin after the $5^{th}$ spin, rolling a "7" will end the feature.

Referring now to FIGS. 8 and 9, it is determined 810 whether a "7" has been rolled. If so, it is determined 812 whether it is one of the first "N" spins, such as where N=4 in the embodiment of FIG. 9. If so, then the "7" is not a terminating event, and a multiplier may optionally be awarded 814 based on a multiplier associated with a dice roll of "7." In the embodiment of FIG. 9, no such multiplier value is associated with rolling a "7." Where the "7" is rolled in the first "N" rolls, the feature does not end, and the reels can again be spun 804.

If a "7" is not rolled as determined at block 810, the multiplier associated with that dice roll is awarded 816. In the embodiment of FIG. 9, the multiplier is dependent on both the dice rolled, and which spin and associated dice roll has occurred. The multiplier may be used in increase any payout provided during the particular spin 804, or alternatively may be accumulated in some fashion. As a terminating dice roll did not occur, the reels can again be spun 804, and the process is repeated. In the illustrated embodiment, the spinning of reels 804 and rolling of dice 808 is repeated until a terminating dice roll of "7" occurs on the $5^{th}$ or subsequent spin 804, at which time the feature ends 818. It should be noted that other embodiments do not involve any guaranteed number of spins, resulting in ending 818 the feature upon a dice roll of "7" as depicted by line 820.

Figure 10:
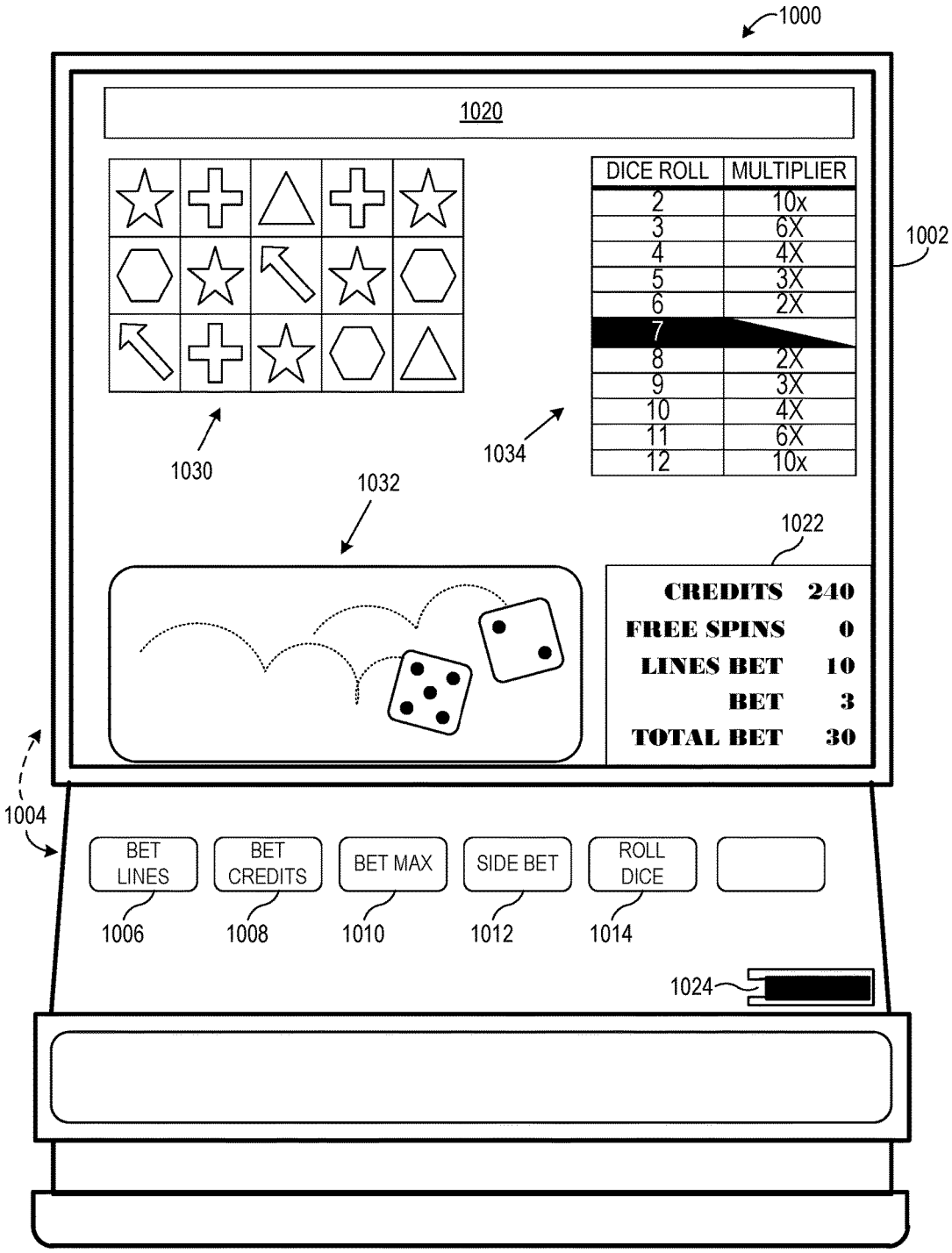
FIG. 10 illustrates a representative embodiment of a casino-style gaming device in which the principles of the present invention may be implemented.

The embodiments described herein may be implemented on computing systems, mechanical or electronic slot machines or other gaming kiosks, hand-held gaming devices, and the like. FIG. 10 illustrates a representative embodiment of a casino-style gaming device in which the gaming features described herein may be applied. While the description of the gaming device is FIG. 10 is provided in terms of a slot machine or similar gaming kiosk, any computer-based system is applicable.

The illustrated gaming machine 1000 includes a computing system (not shown) to carry out operations according to the invention. The illustrated gaming machine 1000 includes a display 1002, and a user interface 1004, although some or all of the user interface 1004 may be provided via the display 1002 in touch screen embodiments.

The user interface 1004 allows the user to control and engage in play of the gaming machine 1000. The particular user interface mechanisms associated with user interface 1004 is dependent on the type of gaming machine. For example, the user interface 1004 may include one or more buttons, switches, joysticks, levers, pull-down handles, trackballs, voice-activated input, or any other user input system or mechanism that allows the user to play the particular gaming activity. The user interface 1004 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 1004 that the user can initiate and engage in gaming activities involving embodiments described herein. For example, the user can use the user interface 1004 and/or touch screen inputs to bet 1006 on a number of items/paylines, bet 1008 a number of credits per item/payline wagered, make gaming decisions such as place a maximum wager 1010 or place secondary or side bets 1012, initiate when the die/dice will be rolled 1014, etc. For example, in one embodiment, the user may be eligible for the roll dice feature described herein when placing a maximum wager, or placing a side bet, or other condition for eligibility. In other embodiments, there is no such eligibility, and the player may be eligible to receive the roll dice feature in the normal course of participating in the gaming event, which may or may not be based on rules indicating when the roll dice feature will be presented to the player. While the illustrated embodiment of FIG. 10 depicts various "buttons" for the user interface 1004, it should be recognized that a wide variety of user interface options are available for use in connection with the present invention, including pressing buttons, touching a segment of a touch-screen, entering text, entering voice commands, or other known user entry methodology.

The display device 1002 may include one or more of an electronic display, a mechanical display, and fixed display information such as information such as paytable information associated with a glass/plastic panel 1020 on the gaming machine 1000. A display segment or panel 1022 may also be provided to display information such as the accumulated credits, free spin "meter," number of lines wagered, current bet amount such as "3" credits (where credits may represent, for example, coins, tokens, dollars, etc.), the total wager for all lines/credits at play, multiplier values such as a running total of multipliers received through the dice feature described herein, the number of credits paid out or "won" on a particular play, etc. A wager acceptor 1024 is operative to receive wager tokens, coins, bills, credit/debit cards, coupons, smart cards, prepaid casino cards, electronic fund transfer (EFT), tickets, and the like.

In the illustrated embodiment, the gaming machine is involved in a gaming event 1030 that may represent the primary or native gaming event in which the player is participating. In this embodiment, the gaming event 1030 is depicted to be a slot game, where symbols are indicative of whether a player receives a payout based on, for example, symbol presentation and/or symbol combination rules. As previously described, embodiments described herein involve a roll dice feature that is depicted at display area 1032 where the resulting state of the dice may be presented (although audio and/or other manners of notifying the player of the resulting dice roll may instead or additionally used). Depending on the embodiment, a table 1034 or other potential award notification area may be provided to enable the participant to know the results of the dice roll feature during participation in the feature and/or after the feature has concluded.

Figure 11:
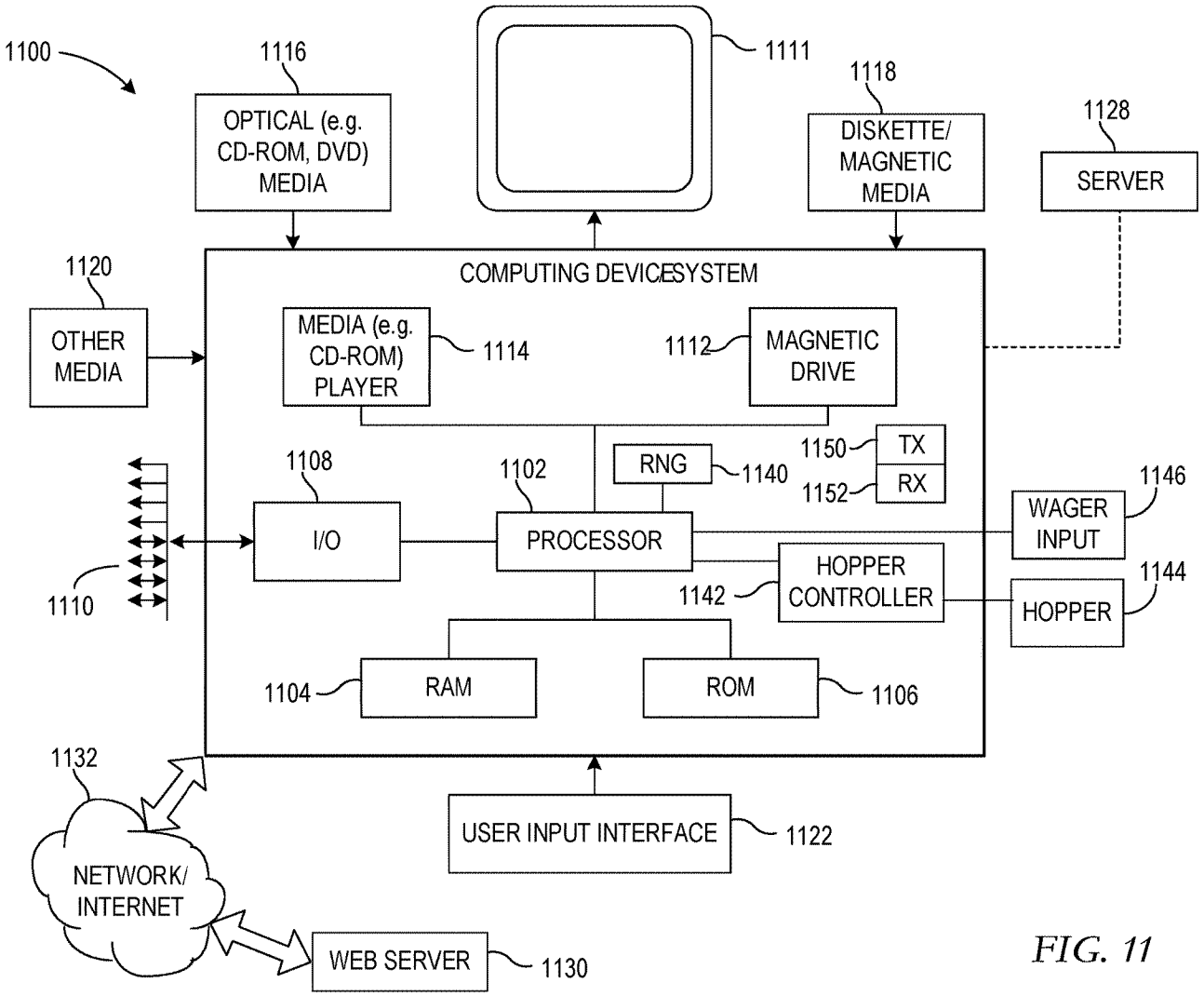
FIG. 11 illustrates representative computing components capable of carrying out operations described herein.

As may now be readily understood, the device 1000 may be programmed to facilitate the embodiments of the invention. The invention may be implemented as a casino gaming machine such as a slot machine, video gaming machine or other special purpose gaming kiosk as described in FIG. 10, or may be implemented via computing systems operating under the direction of local gaming software, and/or remotely-provided software such as provided by an application service provider (ASP). The casino gaming machine utilize a computing system to control and manage the gaming activity. An example of a representative computing system capable of carrying out operations in accordance with the invention is illustrated in FIG. 11.

Hardware, firmware, software or a combination thereof may be used to perform the various gaming functions, display presentations and operations described herein. The functional modules used in connection with the invention may reside in a gaming machine as described, or may alternatively reside on a stand-alone or networked computing device/system. The computing structure 1100 of FIG. 11 is an exemplary computing structure that can be used in connection with such electronic gaming machines, computers, or other computer-implemented devices to carry out operations of the present invention. It should be noted that the representative computing structure of FIG. 11 or analogous computing structure may be used on a local computer, kiosk, server, or any other device providing or serving the gaming functions. It should also be noted that the computing arrangement of FIG. 11 may be distributed across multiple devices (e.g., processing components at a server, and display and user interface components at a local gaming machine, etc.).

The example computing arrangement 1100 suitable for performing the gaming functions in accordance with the invention typically includes a processor (e.g., CPU) 1102, which may be coupled to volatile memory such as random access memory (RAM) 1104 and some variation of read-only memory (ROM) 1106. The depicted ROM 1106 may also represent other types of storage media to store programs, such as programmable ROM (PROM), erasable PROM (EPROM), and other non-volatile memory or storage. The processor 1102 may communicate with other internal and external components through input/output (I/O) circuitry 1108 and bussing 1110, to provide control signals, communication signals, and the like.

The chance-based gaming systems such as slot machines may be governed by random numbers and/or processors. A display device 1111 is used to display the gaming activity as facilitated by one or more random number generators (RNG). RNGs may be implemented using hardware, software operable in connection with the processor 1102, or some combination of hardware and software. The embodiments described herein and their equivalents are operable using any known RNG, and may be integrally programmed as part of the processor 1102 operation, or alternatively may be a separate RNG controller 1140.

The computing arrangement 1100 may also include one or more media read and/or write devices, such as hard and floppy disk drives 1112, optical drives 1114 (e.g., CD-ROM, DVD, etc.), and other hardware capable of reading and/or storing information such as FLASH and other solid state storage devices, etc. In one embodiment, software for carrying out the operations in accordance with the invention may be stored and distributed on optical media 1116 such as CD-ROM and DVD, magnetic media such as hard disks or diskette 1118, FLASH and other solid state storage or other form of media 1120 capable of storing information. These storage media may be inserted into, and read by, devices such as the optical drive 1114, the magnetic drive 1112, hardware receptacles for portable media, etc. The software may also be transmitted to the computing arrangement 1100 via data signals, such as being downloaded electronically via a network, such as the Internet. Further, as previously described, the software for carrying out the functions associated with the present invention may alternatively be stored in internal memory/storage of the computing device 1100, such as in RAM 1104, ROM 1106, or other storage.

The computing arrangement 1100 is coupled to the display(s) 1111, which represents a display on which the gaming activities are presented. The display 1111 may be any type of known display or presentation screen, such as LCD displays, plasma display, cathode ray tubes (CRT), etc. Where the computing device 1100 represents a stand-alone or networked computer, the display 1111 may represent a standard computer terminal or display, which may also be capable of displaying multiple windows, frames, etc. Where the computing device is embedded within an electronic gaming machine (see FIG. 10), the display(s) 1111 corresponds to the display screen(s) of the gaming machine/kiosk. A user input interface 1122 such as a mouse, buttons, keyboard/keypad, microphone, touch pad, trackball, joystick, touch screen, voice-recognition system, etc. may be provided.

The computing arrangement 1100 may be connected to other computing devices or gaming machines, such as via a network(s). The computing arrangement 1100 may be connected to a network server 1128 in an intranet or local network configuration. The computer may further be part of a larger network configuration as in a global area network (GAN) such as the Internet. In such a case, the computer accesses one or more web servers 1130 via the network/Internet 1132.

Other components directed to gaming machine implementations include manners of gaming participant payment, and gaming machine payout. For example, a gaming machine including the computing arrangement 1100 may also include a hopper controller 1142 to determine the amount of payout to be provided to the participant. The hopper controller may be integrally implemented with the processor 1102, or alternatively as a separate hopper controller 1142. A hopper 1144 may also be provided in gaming machine embodiments, where the hopper serves as the mechanism holding the coins/tokens of the machine. The wager input module 1146 represents any mechanism for accepting coins, tokens, coupons, bills, electronic fund transfer (EFT), tickets, credit cards, smart cards, membership cards, etc., for which a participant inputs a wager amount.

Additionally, the computing arrangement 1100 may include a transmitter (TX) 1150, and may include a receiver (RX) 1152. These TX 1150 and RX 1152 components may be discrete components, or aggregated such as in the case of a transceiver. The receiver function provided by the RX 1152 can be configured to receive information from any type of network, such as a local area network (LAN), wireless LAN (e.g., 802.11 a/b/g), wired network (e.g., Internet), wireless network (e.g., Global System for Mobile Communications/General Packet Radio Service (GSM/GPRS), proximity networks (e.g., Bluetooth, peer-to-peer networks), and/or other wired/wireless network technologies. For example, the RX 1152 may receive programming and/or operational information from a server 1128 or 1130 where the system is server-based. Any such server may include computing components analogous to those depicted in FIG. 11. Information such as wager information or other data used by a server can be provided to the appropriate server 1128, 1130 or other device or network entity via the TX 1150.

It should also be recognized that the computing arrangement 1100 of FIG. 11 may be implemented in a gaming apparatus, and/or in a server or other network entity that determines and provides features in accordance with the invention.

Using computing structure, a computer-readable medium may be provided that has instructions stored thereon that are executable by the computing structure to perform methods described herein. For example, in one embodiment, a computer-readable medium is provided that has instructions stored thereon which are executable by a computer system by performing steps including facilitating participation in a gaming event, presenting at least one die, identifying an award-enhancing opportunity in response to a number presented on the at least one die, enabling repetition of the presentation of the at least one die and the identification of the award-enhancing opportunity in response to the number presented until a triggering event occurs by way of the presentation of the at least one die, enabling aggregation of the identified award-enhancing opportunities occurring during the repetition, and enhancing payout opportunities relative to the participation in the gaming event using the aggregation of the identified award-enhancing opportunities.

In another representative embodiment, a computer-readable medium is provided that has instructions stored thereon which are executable by a computer system by performing steps including facilitating participation in a gaming event, presenting at least one die, identifying a mathematical augmentation value in response to a number presented on the at least one die, providing a quantity of guaranteed repetitions of the presentation of the at least one die and the identification of the mathematical augmentation value in response to the number presented, following the guaranteed repetition enabling conditional repetition of the presentation of the at least one die and the identification of the mathematical augmentation value in response to the number presented until a triggering event occurs by way of the presentation of the at least one die, and enhancing payout opportunities relative to the participation in the gaming event using the identified mathematical augmentation values.

The principles described herein can also be applied to other electronic wagering games such as video poker. For example, the player can participate in a video poker game where dice may be rolled in connection with a resulting hand(s) in the manners described above. In one particular embodiment, a dice roll event may be allowed upon completion of every resulting hand, upon obtaining a particular poker rank, upon obtaining at least a particular poker rank, upon receiving a mystery bonus, upon payment by the player of a side wager, etc. In this representative embodiment, the player may obtain enhanced payouts through multipliers provided by way of the dice, free hands (analogous to free spins) provided by way of the dice, etc. Thus, in some embodiments, the dice roll features described herein may be implemented as a secondary game to various electronic gaming and casino-based primary games. In such embodiments, the dice roll feature may be a bonus feature triggered randomly or in connection with some predetermined event (s), or may be provided in connection with each primary gaming event.

From the description provided herein, those skilled in the art are readily able to combine software created as described with appropriate general purpose or special purpose computer hardware to create a mobile computer system and/or computer subcomponents embodying the invention, and to create a mobile computer system and/or computer subcomponents for carrying out methods of the invention.

The foregoing description of the exemplary embodiments has been presented for the purposes of illustration and description. It is not intended to be exhaustive or to limit the invention to the precise form disclosed. Many modifications and variations are possible in light of the above teaching.

The invention claimed is:

1. A method of operating a gaming device including a display device having a symbol display grid, a player interface including at least one button, a memory configured to store a credit amount, a wager input device structured to receive physical items associated with a currency value, and a processor, the method comprising:

receiving a signal indicating receipt of a physical item associate with a currency value;

increasing the credit amount stored in the memory based on the currency value associated with the received physical item;

facilitating participation in a gaming event shown on the display device of the gaming device as a result of receiving a wager of at least a portion of the credit amount stored in the memory, presenting at least one die and a table of awards related to potential roll outcomes of the at least one die on the display device, wherein at least one of the outcomes in the table is associated with an ending triggering event, activating a first roll process of the at least one die, displaying an outcome of the first roll process on the display device by showing a face of the at least one die, identifying an award-enhancing opportunity in response to the outcome of the first roll process by determining an award in the table associated with the displayed outcome;

altering, after the first roll, an award amount associated with the at least one outcome associated with the ending triggering event in the table when the first roll does not result in an outcome associated with the ending triggering event;

enabling repetition of additional roll processes and identification of award-enhancing opportunities until an outcome of an additional roll process is associated with the ending triggering event;

aggregating the identified award-enhancing opportunities occurring during the first roll process and occurring during any additional roll processes in the repetition; and enhancing payout opportunities relative to the participation in the gaming event using the aggregation of the identified award-enhancing opportunities.

2. The method of claim 1, wherein:

identifying an award-enhancing opportunity comprises identifying a multiplier value from the table corresponding to the displayed outcome of the associated roll process; and enabling aggregation of the identified award-enhancing opportunities occurring during the repetition comprises enabling the identified multiplier values to be summed together into an accumulated multiplier during the repetition.

3. The method of claim 2, wherein enhancing payout opportunities relative to the participation in the gaming event using the aggregation of the identified award-enhancing opportunities comprises multiplying the accumulated multiplier value times a wager placed in the gaming event.

4. The method of claim 2, wherein enhancing payout opportunities relative to the participation in the gaming event using the aggregation of the identified award-enhancing opportunities comprises multiplying the accumulated multiplier value times a payout provided during participation in the gaming event.

5. The method of claim 1, wherein identifying an award-enhancing opportunity comprises identifying a number of free plays corresponding to the displayed outcome of the roll process, wherein the free plays are applied to the gaming event.

6. The method of claim 5, wherein enabling aggregation of the identified award-enhancing opportunities occurring during the repetition comprises enabling, during the repetition, the identified number of free plays to be added to a current number of free plays available in the gaming event.

7. The method of claim 1, wherein enabling repetition of additional roll processes and identification of award-enhancing opportunities comprises:

enabling repetition of the presentation of the at least one die and the identification of the award-enhancing opportunity in response to the displayed outcome of the roll process being any one of a first set of results in the table; and discontinuing the repetition of the presentation of the at least one die and the identification of the award-enhancing opportunity in response to the displayed outcome of the roll process being any one of a second set of results in the table associated with ending triggering events.

8. The method of claim 7, wherein:

the at least one die comprises a pair of dice;

the first set of results comprises the dice results of 2, 3, 4, 5, 6, 8, 9, 10, 11 and 12; and the second set of results comprises the dice result of 7.

9. The method of claim 8, wherein the game circuitry is further operable to enable repetition of the presentation of the dice and the identification of the award-enhancing opportunity if the first presentation of the dice is a 7, and discontinuing the repetition of the presentation of the dice and the identification of the award-enhancing opportunity on the next presentation of 7 on the dice.

10. The method of claim 1, wherein enhancing payout opportunities comprises mathematically increasing actual payouts using the aggregation of the identified award-enhancing opportunities.

11. The method of claim 1, wherein the gaming event comprises a slot game involving payouts for matching symbols in a symbol display grid.

12. The method of claim 11, further comprising triggering a gaming feature upon occurrence of at least one defined triggering event occurring during participation in the slot game, wherein the gaming feature comprises the presentation of the at least one die, the identification of the award-enhancing opportunity, the enabling of the repetition of the presentation of the at least one die and the identification of the award-enhancing opportunity, the enabling of the aggregation of the identified award-enhancing opportunities, and the enhancement of the payout opportunities.

13. The method of claim 1, wherein activating a first roll process of the at least one die includes:

displaying the at least one die on a video gaming display; and receiving a player input to roll the at least one die on the video gaming display.

* * * * *